US008671623B2

(12) United States Patent
Dodson et al.

(10) Patent No.: US 8,671,623 B2
(45) Date of Patent: Mar. 18, 2014

(54) VEHICLE DOOR MANUAL LOCK ASSEMBLY

(75) Inventors: Lisa J. Dodson, Ortonville, MI (US); Jeffrey L. Konchan, Romeo, MI (US); Richard K. Mette, Shelby Township, MI (US); Carolyn J. Thor, Lake Orion, MI (US); Frank J. Arabia, Jr., Macomb, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 56 days.

(21) Appl. No.: 13/440,175

(22) Filed: Apr. 5, 2012

(65) Prior Publication Data

US 2013/0263517 A1 Oct. 10, 2013

(51) Int. Cl.
*E06B 3/00* (2006.01)

(52) U.S. Cl.
USPC ..... 49/503; 49/140; 49/449; 49/394; 70/237; 70/239; 70/279.1

(58) Field of Classification Search
USPC ..... 49/503, 139, 140, 449, 394; 292/292, 292/DIG. 23, 201, 216; 70/237, 277, 278.7, 70/279.1, 262, 263, 360, 361
See application file for complete search history.

(56) References Cited

U.S. PATENT DOCUMENTS

| | | | | |
|---|---|---|---|---|
| 2,837,906 | A * | 6/1958 | Krauss | 70/153 |
| 5,595,409 | A * | 1/1997 | Fier et al. | 292/112 |
| 6,564,602 | B2 * | 5/2003 | Gregory | 70/360 |
| 6,843,085 | B2 * | 1/2005 | Dimig | 70/237 |
| 6,848,737 | B2 * | 2/2005 | Mikolai et al. | 296/146.9 |
| 6,964,184 | B1 * | 11/2005 | Gregory | 70/360 |
| 7,004,516 | B2 * | 2/2006 | Stojc | 292/201 |
| 2001/0022051 | A1 * | 9/2001 | Fukumoto et al. | 49/503 |
| 2005/0046200 | A1 * | 3/2005 | Dominique | 292/216 |
| 2007/0074550 | A1 * | 4/2007 | Isaacs | 70/279.1 |

FOREIGN PATENT DOCUMENTS

GB 2168748 A * 6/1986 ..... E05C 3/34

* cited by examiner

*Primary Examiner* — Katherine Mitchell
*Assistant Examiner* — Marcus Menezes

(57) ABSTRACT

A door of a vehicle having a door inner panel, a door latch assembly mounted to the inner panel adjacent to a fish mouth opening, with the latch assembly having a lock lever; and a door trim panel mounted on the inner panel including a lock hole on a surface of the trim panel. A manual lock assembly has a mounting bracket, a button cap, a main shaft and a cam. The mounting bracket is mounted to the door trim panel. The button cap telescopically slides in the bracket and has an end extending through the lock hole. The main shaft slides in the bracket, engages with the button cap and extends into contact with the cam. The cam engages the lock lever to cause locking of the latch assembly when the button cap is pushed.

8 Claims, 4 Drawing Sheets

VEHICLE DOOR MANUAL LOCK ASSEMBLY

BACKGROUND OF INVENTION

The present invention relates generally to vehicle doors and more particularly to manual locking mechanisms on vehicle doors.

Automotive vehicles that have power door locks also typically have some type of manual locking and unlocking mechanisms to allow for door locking and unlocking should the electric power fail or the power lock system malfunction. For many conventional vehicles, this includes conventional lock knobs extending upward from a door sill at the bottom of the door's window opening. However, for esthetic reasons, it may be desirable to eliminate such conventional lock knobs. Also, for functional reasons, one may wish to eliminate the lock rod that extends from the door latch to the knob extending from the sill for improved assembly and reliability. The need remains, though, for manual locking and unlocking when the power door lock system is not operating.

Some have attempted to overcome this by providing a slot in the fish mouth area or an open hole in the shut-face of the door with into which a person must insert a key and rotate it to manually lock the door. However, this requires a key to lock the door and also leaves an open hole (key slot) along the back side of the door into which debris may enter.

SUMMARY OF INVENTION

An embodiment contemplates a door of a vehicle having vehicle structure defining a door opening. The door includes a door inner panel having an inboard side and a shut face adjacent to and facing the vehicle structure of the door opening when the door is in a closed position, with the shut face having a fish mouth opening. The door also includes a door latch assembly mounted to the door inner panel adjacent to the fish mouth opening, with the door latch assembly having a lock lever; and a door trim panel having a surface facing the same general direction as the shut face and including an access hole therethrough, the door trim panel being mounted on the inboard side of the door inner panel. Also, the door includes a manual lock assembly having a mounting bracket, a button cap, a main shaft and a cam; the mounting bracket mounted to the door trim panel and including a support drum; the button cap telescopically slidable in the support drum and having an engagement end adjacent to and facing the vehicle structure of the door opening when the door is in the closed position, the button cap extending through the access hole; and the main shaft telescopically slidable in the support drum, engaged with the button cap and extending from the support drum in a direction opposite from the button cap into contact with the cam, the cam configured to operatively engage the lock lever to cause locking of the door latch assembly when the button cap is pushed.

An embodiment contemplates a method of manually locking a door of a vehicle having a vehicle structure defining a door opening, the method comprising the steps of: opening the door; pressing on a button cap extending through an access hole in a surface of a door trim panel adjacent to a door shut face, the door shut face being adjacent to and facing the vehicle structure of the door opening when the door is in a closed position, and the surface of the door trim panel generally facing the same direction as the door shut face; engaging a main shaft of a manual lock assembly with the button cap when the button cap is pressed to cause the main shaft to telescopically slide; engaging a contact shaft with the main shaft as the main shaft slides to cause the contact shaft to pivot a cam; pivoting a lock lever on a door latch assembly when the cam is pivoted to thereby cause the door latch assembly to lock the door; and releasing the button cap and closing the door.

An advantage of an embodiment is that a simple and quick means for manually locking a door of a vehicle having power locks, when the power lock operation is not working, is achieved. The capability to manually lock a door is provided without the need for a sill lock knob, which can be esthetically unpleasing and possibly functionally less reliable. The distance between the door latch assembly and the manual lock button is minimized, and no key or tool is needed to manually lock the door. Moreover, there is no need for a plug or other means to cover a hole in the door shut face to prevent debris from entering the door.

DETAILED DESCRIPTION

Figure 1:
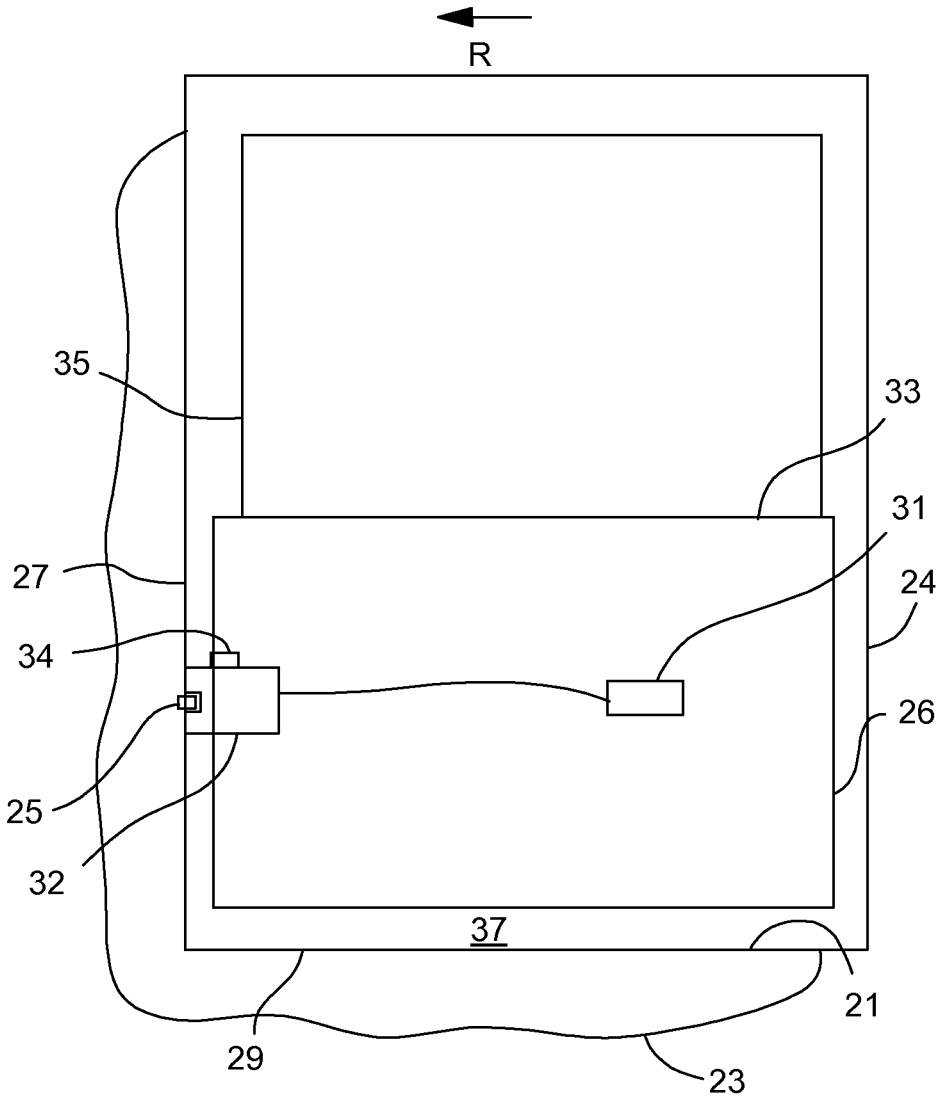
FIG. 1 is a schematic view looking outboard at a portion of a vehicle body and a vehicle door.
Figure 2:
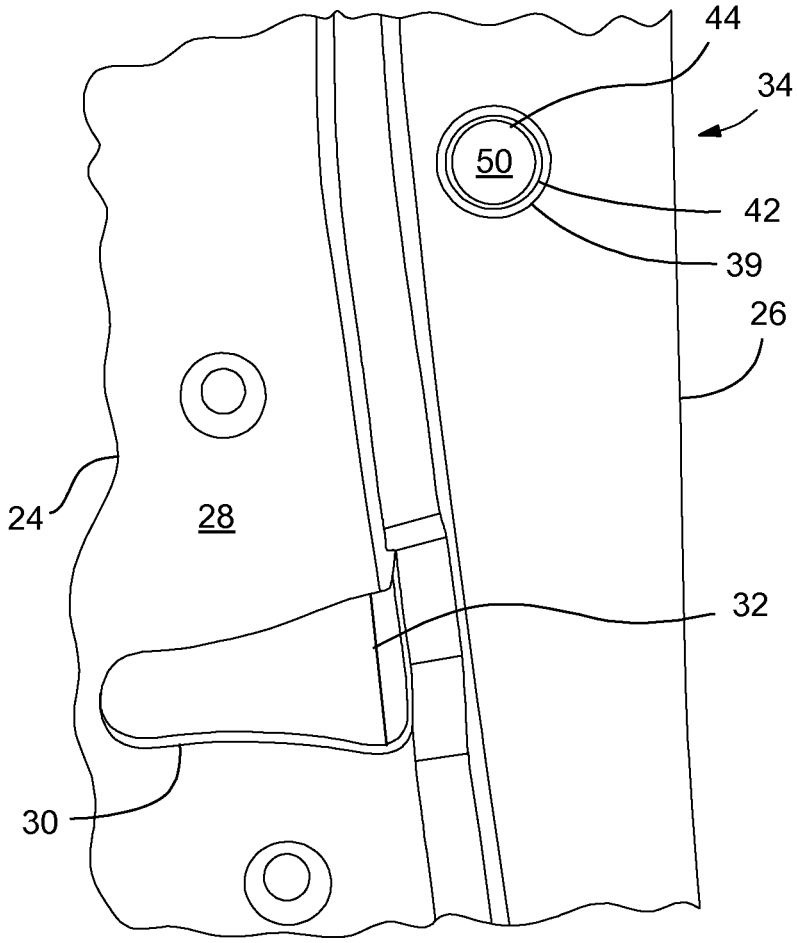
FIG. 2 is a schematic view looking forward at a side door inner panel and door trim panel of a vehicle side door.
Figure 3:
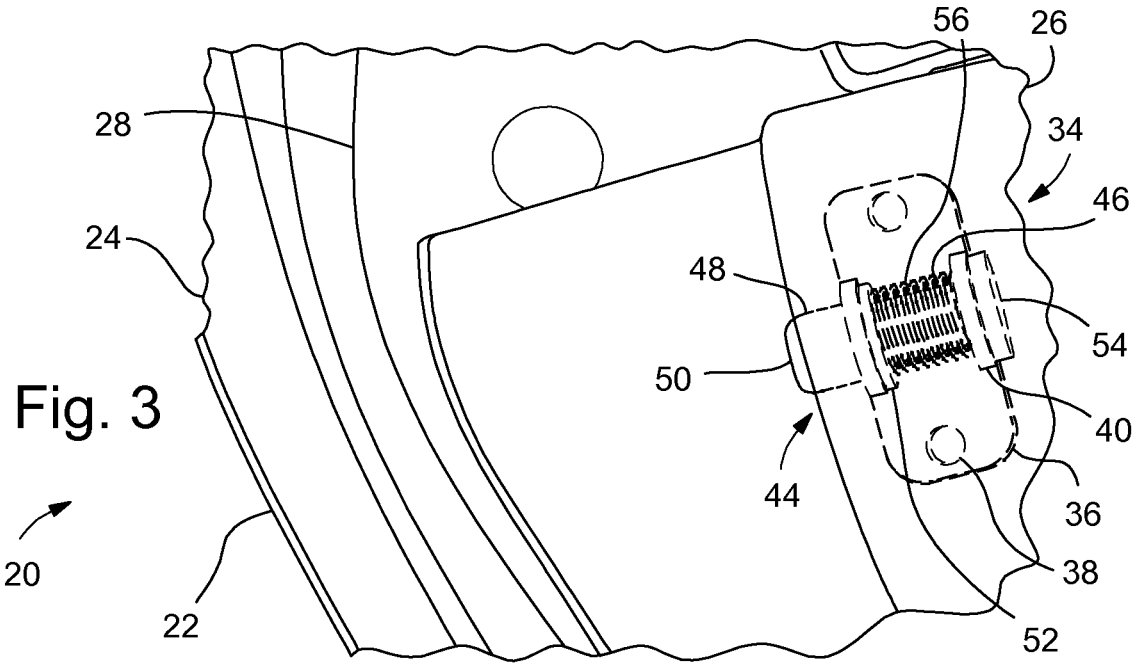
FIG. 3 is a schematic view looking outboard at the side door inner panel and the door trim panel.
Figure 4:
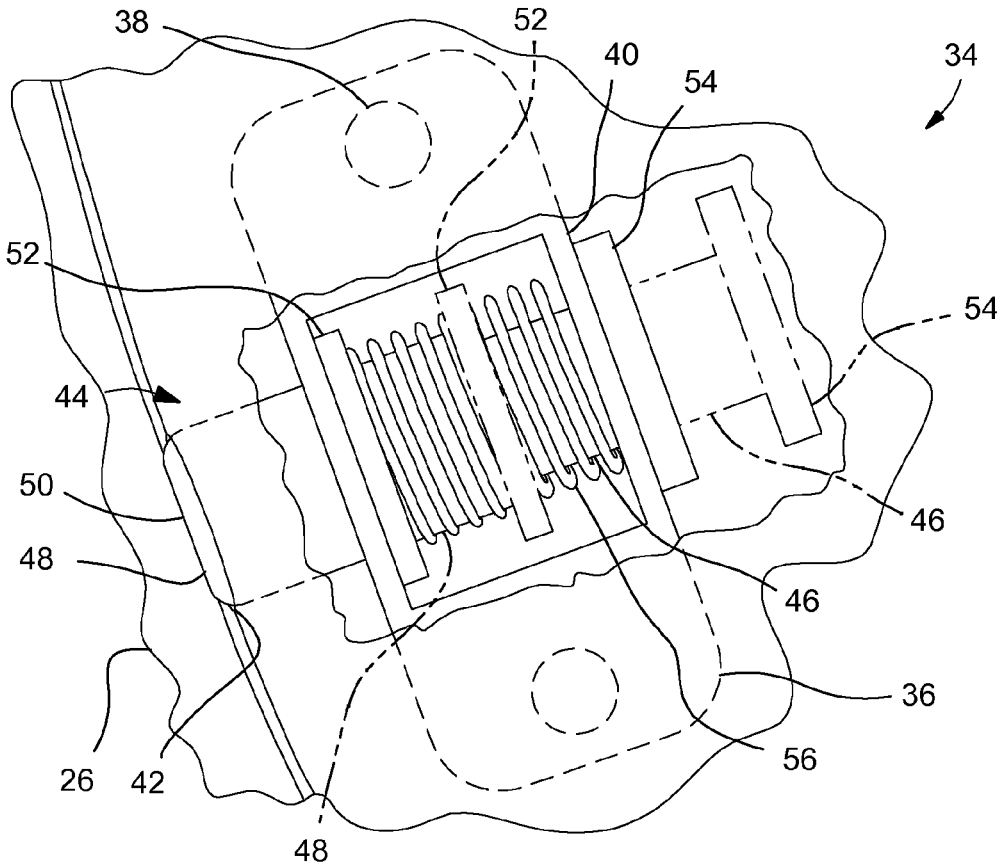
FIG. 4 is a schematic, partially cutaway view of a the door trim panel and manual lock assembly, with a main shaft and button cap of the manual lock assembly shown in two positions, a retracted position in solid lines and an extended position in phantom lines.
Figure 6:
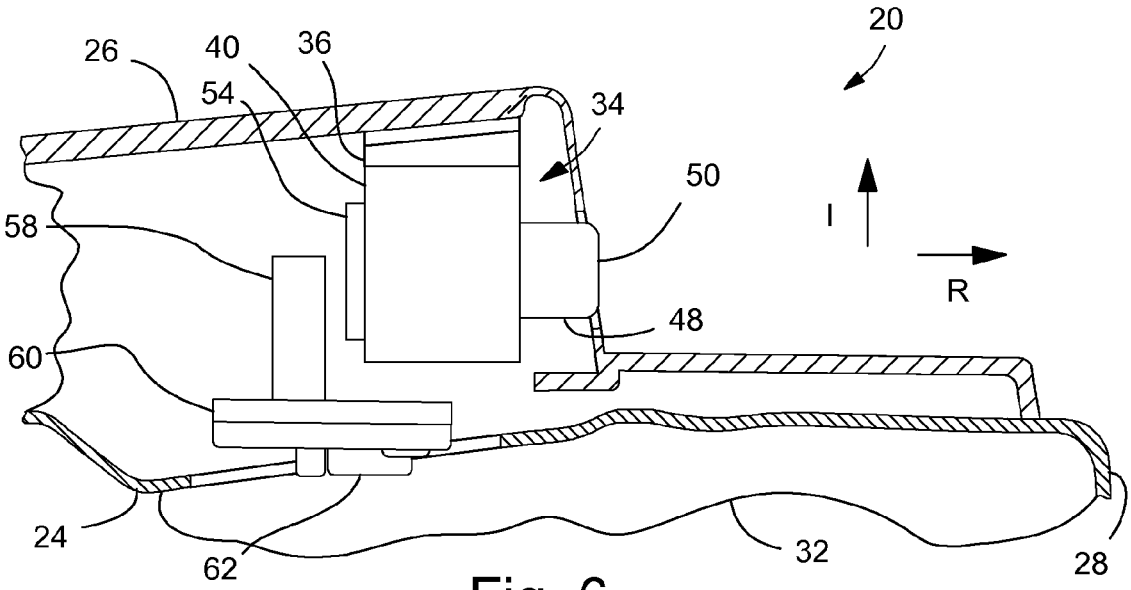
FIG. 6 is a schematic, plan view, in partial cross section, of the side door inner panel, door trim panel, manual lock assembly and latch assembly.
Figure 5:
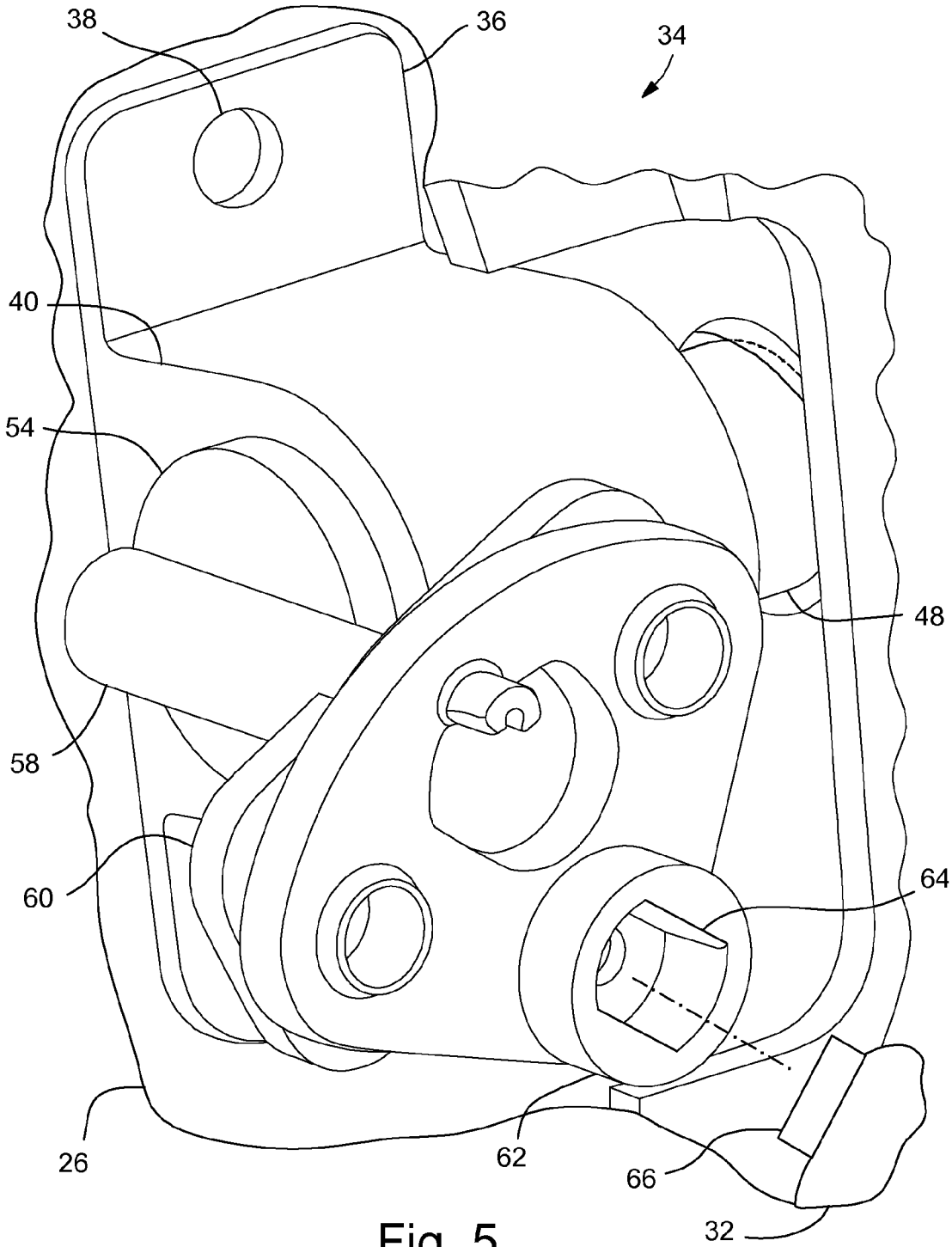
FIG. 5 is a schematic, partially exploded, perspective view looking rearward and inboard at the manual lock assembly, the door trim panel and a latch assembly.

Referring to FIG. 1, a vehicle door 20 is mounted in a door opening 21 of a vehicle structure 23, such as, for example, a portion of a vehicle body. The door may be, for example, a vehicle side door, front or back side door, mounted to the vehicle structure 23. The door may also be, for example, a rear door of a vehicle. A striker 25 may be mounted to the vehicle structure 23 in the door opening 21 and engage a door latch assembly 32 to hold the door 20 in a closed position. The striker 25 may also be mounted to an adjacent door if the door 20 is part of a pair of doors in side-by-side arrangement, in which case the door with the striker 25 mounted to it, in effect, forms part of the door opening 21 for the door 20. The vehicle structure 23, door opening 21, striker 25 and latch 32 may be conventional and so will not be shown in detail herein. While the door striker 25 and latch 32 are shown along a vertical side 27 of the door 20, they may be located along a bottom edge 29 of the door 20, if so desired. Also, as discussed above, the door opening structure may include a portion of a second door when the door 20 is part of a pair of side-by-side doors, such as, for example, the rear doors on a full size van. A side-by-side door arrangement is also conventional and known to those skilled in the art.

The door 20 may include a door inner panel 24 and a door trim panel 26 mounted to an inboard side 37 of the door inner panel 24. The latch assembly 32 may be mounted to the door inner panel 24. An inside door handle 31 may be connected to the latch assembly 32 and actuated by a vehicle occupant to release the latch assembly 32 from the striker 25. A door sill 33 is formed along the top edge of the door trim panel 26, adjacent to the bottom edge of a window 35. The inside door handle 31, latch assembly 32, and window 35 may be conventional and so will not be shown in more detail herein. A manual lock assembly 34, discussed in more detail below, may be mounted to the door trim panel 26.

Now referring to FIGS. 1-6, with reference to a side door (but also applicable to a rear door on a vehicle) the side door 20 includes a door outer panel 22 (shown schematically in FIG. 3), which forms an outer surface of the side door 20, the door inner panel 24, which is mounted inboard of the outer panel 22, and the door trim panel 26, which is mounted to the inboard side 37 of the door inner panel 24. The rearward direction of the door in its closed position (relative to the vehicle) is indicated by an arrow marked R in FIGS. 1 and 6, the inboard direction of the door (relative to the vehicle) is indicated by an arrow marked I in FIG. 6.

The rear side of the door inner panel 24 of the door 20 defines a shut face 28, which faces rearward toward the portion of the vehicle structure 23 that defines the rear of the door opening 21 into which the door 20 closes. The shut face 28 has a fish mouth opening 30 into which the striker 25 slides during door closing. The striker 25 can be conventional and engages with a portion of a door latch assembly 32, which is mounted to the door inner panel 24 around the fish mouth opening 30. The latch assembly 32 may also be conventional and so is only shown schematically herein. The latch assembly 32 also acts as a lock for the side door 20 by selectively allowing for or preventing the release of the striker 25. This function is conventional and so will not be discussed further herein.

The term shut face, as used in the specification and claims of the present application, includes the portion of the door inner panel 24 that faces and is adjacent to the door opening 21 (vehicle structure 23) along the side of the door 20 where the latch assembly 32 engages the striker 25. Thus, the term shut face does not include the door sill 33 adjacent to the window 35. The vehicle structure 23 forming the door opening 21 may be fixed body structure or may be a second door for a vehicle having a side-by-side door arrangement, with the vehicle structure 23 having the striker 25 mounted to it.

The manual lock assembly 34 includes a manual button mounting bracket 36 that may include mounting holes 38 for mounting to the door trim panel 26. The mounting may be accomplished using heat staking, adhesive, fasteners or other typical attachment methods. The mounting bracket 36 also includes a support drum 40 having a lock hole 42 through which a lock button assembly 44 telescopically slides. The manual lock assembly 34 may be located adjacent to (inboard of) the door latch assembly 32 at the same elevation, somewhat above or somewhat below the latch assembly 32, as desired.

The lock button assembly 44 includes a telescopically slidable main shaft 46 upon which a button cap 48 is telescopically mounted. Thus, the main shaft 46 and the button cap 48 can telescopically slide in the lock hole 42 of the support drum 40. The button cap 48 includes a rearward facing finger engagement end 50, which is accessible by a human finger or other object through an access hole 39 in the door inner panel 24 for pushing on by someone manually locking the door, and a travel stop 52 that limits the rearward travel of the button cap 48. For a door where the latch is along a shut face on the lower edge of the door, the finger engagement end 50 faces downward instead of rearward and the travel stop 52 limits downward travel—in either case, the finger engagement end 50 faces toward the structure 23 of the door opening 21 adjacent to the latch assembly 32 (when the door 20 is in the closed position). The button cap 48 only needs to stick out of the access hole 39 in the door trim panel 26 by a small amount, enough for one to see the button cap 48 and push on it with a finger or other small object.

The main shaft 46 includes a cam contact head 54. The cam contact head 54 has a large enough diameter that it will abut the support drum 40 to limit the amount of rearward travel of the main shaft 46. A spring 56 mounts around the main shaft 46 and is engaged between the support drum 40 of the bracket 36 and the travel stop 52 of the button cap 48 for biasing the button cap 48 toward the access hole 39.

The cam contact head 54 can be moved into engagement with a contact shaft 58 of a cam 60. The cam 60 includes a boss 62 with a latch engagement slot 64, which engages a lock lever 66 on the door latch assembly 32. The cam 60 pivots about the boss 62, which is offset axially from the contact shaft 58, thus when the contact shaft 58 is moved by the cam contact head 52, the boss 62 is pivoted.

The operation of the manual lock assembly 34 on the side door 20 will now be discussed. Under typical operating conditions, a vehicle power lock system (not shown) is used to lock and unlock the vehicle doors. However, should the power door lock system fail, such as, for example, when the vehicle loses electric power, then an alternative manual means of locking the doors is available. (Unlocking the side doors manually typically involves pulling on the interior door handles, which simultaneously unlock and unlatch the door, and so will not be discussed further herein.) To lock the door 20, the door 20 is opened to allow access to the button cap 48. One then pushes on the engagement end 50 of the button cap 48. As the button cap 48 moves into the door 20 against the bias of the spring 56, the button cap 48 pushes the main shaft 46 forward. This causes the cam contact head 54 to move forward, pressing on the side of the contact shaft 58. As the contact shaft 58 is moved, the cam 60 pivots, causing the latch engagement slot 64 of the boss 62 to pivot the lock lever 66 of the door latch assembly 32. The pivoting of the lock lever 66 causes the door latch assembly 32 to lock the door 20. Upon releasing one's finger from the button cap 48, the spring moves the button cap 48 outward until the travel stop 52 abuts the support drum 40. The door 20 can then be closed, with the door locked.

The next time the door latch assembly 32 is unlocked, the latch assembly 32 pivots the lock lever 66 to the unlocked position, which pushes the main shaft 46 toward the support drum 40 of the button mounting bracket 36.

While certain embodiments of the present invention have been described in detail, those familiar with the art to which this invention relates will recognize various alternative designs and embodiments for practicing the invention as defined by the following claims.

What is claimed is:

1. A door of a vehicle having vehicle structure defining a door opening, the door comprising:

a door inner panel having an inboard side facing inboard relative to the vehicle and a shut face oriented substantially normal to the inboard side and adjacent to and facing the vehicle structure of the door opening when the door is in a closed position, the shut face having a fish mouth opening to receive a striker therein;

a door latch assembly mounted to the door inner panel adjacent to the fish mouth opening, the door latch assembly having a lock lever;

a door trim panel having a surface facing the same general direction as the shut face and including an access hole therethrough, the access hole being located inboard of the door inner panel in relation to the vehicle, the door trim panel being mounted on the inboard side of the door inner panel; and a manual lock assembly having a mounting bracket, a button cap, a main shaft and a cam; the mounting bracket mounted to the door trim panel and including a support drum; the button cap telescopically slidable in the support drum and having an engagement end adjacent to and facing the vehicle structure of the door opening when the door is in the closed position, the button cap extending through the access hole; and the main shaft telescopically slidable in the support drum, engaged with the button cap and extending from the support drum in a direction opposite from the button cap into contact with the cam, the cam operatively engaging the lock lever to cause locking of the door latch assembly when the button cap is pushed.

2. The door of claim 1 wherein the manual lock assembly includes a spring engaged between the button cap and the mounting bracket, the spring biasing the button cap through the access hole.

3. The door of claim 2 wherein the button cap includes a travel stop that engaging the support drum to limit the travel of the button cap due to bias of the spring.

4. The door of claim 1 wherein the main shaft includes a cam contact head on an end of the shaft; and the cam includes a contact shaft engaged with the cam contact head and a boss pivotally offset from the contact shaft, the boss including a latch engagement slot rotationally engaging the lock lever.

5. The door of claim 1 wherein the main shaft is telescopically slidable into the button cap.

6. A method of manually locking a door of a vehicle having a vehicle structure defining a door opening, the method comprising the steps of:

(a) opening the door;

(b) pressing on a button cap extending through an access hole in a surface of a door trim panel adjacent to and inboard of a door shut face of a door inner panel, the door shut face being adjacent to and facing the vehicle structure of the door opening when the door is in a closed position, and the surface of the door trim panel generally facing the same direction as the door shut face and being inboard of the door shut face in relation to the vehicle;

(c) engaging a main shaft of a manual lock assembly with the button cap when the button cap is pressed to cause the main shaft to telescopically slide;

(d) engaging a contact shaft with the main shaft as the main shaft slides to cause the contact shaft to pivot a cam;

(e) pivoting a lock lever on a door latch assembly, which is mounted to the door inner panel, when the cam is pivoted to thereby cause the door latch assembly to lock the door;

(f) releasing the button cap; and (g) closing the door, causing the door latch assembly to engage a striker mounted to the vehicle structure as the striker enters a fish mouth opening in the door inner panel.

7. The method of claim 6 wherein step (b) is further defined by the pressing of the button cap moving the button cap telescopically against the bias of a spring.

8. The method of claim 7 wherein step (f) is further defined by the spring moving the button cap outward partially through the access hole when the button cap is released.

* * * * *